US006971366B2

(12) United States Patent
Funke et al.

(10) Patent No.: US 6,971,366 B2
(45) Date of Patent: Dec. 6, 2005

(54) INTEGRAL LASH ADJUSTOR FOR HYDRAULIC COMPRESSION ENGINE BRAKE

(75) Inventors: Steven J. Funke, Princeville, IL (US); Michael P. Harmon, Dunlap, IL (US); Scott A. Leman, Eureka, IL (US); Matthew G. Mickiewicz, Clayton, NC (US)

(73) Assignee: Caterpillar Inc., Peoria, IL (US)

( * ) Notice: Subject to any disclaimer, the term of this patent is extended or adjusted under 35 U.S.C. 154(b) by 503 days.

(21) Appl. No.: 09/939,952

(22) Filed: Nov. 30, 2001

(65) Prior Publication Data

US 2003/0101965 A1 Jun. 5, 2003

(51) Int. Cl.[7] ..... F02D 13/04

(52) U.S. Cl. ..... 123/321; 123/90.16; 123/320; 123/322

(58) Field of Search ..... 123/320, 321, 123/322, 323, 90.16

(56) References Cited

U.S. PATENT DOCUMENTS

| | | | | |
|---|---|---|---|---|
| 4,175,534 A | | 11/1979 | Jordan | |
| 4,271,796 A | | 6/1981 | Sickler et al. | |
| 4,384,558 A | | 5/1983 | Johnson | |
| 4,398,510 A | | 8/1983 | Custer | |
| 4,473,047 A | | 9/1984 | Jakuba et al. | |
| 4,706,625 A | | 11/1987 | Meistrick et al. | |
| 4,742,806 A | | 5/1988 | Tart, Jr. et al. | |
| 5,186,141 A | | 2/1993 | Custer | |
| 5,201,290 A | | 4/1993 | Hu | |
| 5,460,131 A | | 10/1995 | Usko | |
| 5,511,460 A | * | 4/1996 | Custer | 91/401 |
| 6,082,328 A | * | 7/2000 | Meistrick et al. | 123/321 |
| 6,253,730 B1 | * | 7/2001 | Gustafson | 123/321 |
| 6,321,717 B1 | * | 11/2001 | Faletti | 123/321 |

* cited by examiner

*Primary Examiner*—Henry C. Yuen
*Assistant Examiner*—Johnny H. Hoang
(74) *Attorney, Agent, or Firm*—Jenken Gilchrist

(57) ABSTRACT

Engine compression release brakes include some degree of lash between the brake actuation portion and the engine exhaust valve portion. The disclosed apparatus and method provides an integral lash adjuster that includes an adjusting screw that is threadably received by a slidable plunger. Rotation of the adjusting screw causes the plunger to slide relative to a plunger cavity and responsively modify the amount of lash.

43 Claims, 7 Drawing Sheets

10
68
94
112
110
113
52
58
102
104
106
12
89
16
18

INTEGRAL LASH ADJUSTOR FOR HYDRAULIC COMPRESSION ENGINE BRAKE

TECHNICAL FIELD

The present invention relates generally to a hydraulic compression engine brake, and more particularly to an integral lash adjustor.

BACKGROUND ART

For many years it has been recognized that vehicles, and particularly trucks, equipped with internal combustion engines of the Otto or Diesel type should be provided with some form of engine retarder in addition to the usual wheel brake. The reason for this is the momentum of a heavily loaded vehicle descending a long grade may easily overcome the capacity for continuous braking of the wheel braking system. Many of these retarders are mechanical in nature, and thus limited in their flexibility for exhaust valve opening due to the fixed structure of the engine brake. The lack of flexibility produces fixed openings of the exhaust valve during the engine cycle, which creates excessive noise.

Compression release engine brakes are well known as shown, for example, by U.S. Pat. No. 5,186,141, issued on Feb. 16, 1993 to Custer. The Custer patent mentioned above relates to a mechanism for automatically adjusting the "lash" of an engine brake when the brake is turned on or off. The lash is the cold-engine clearance between each slave piston in the engine brake and the engine component on which that slave piston acts when the engine brake is turned on. It is necessary to have sufficient lash to account for transient and thermal growth of the engine components when the engine is in operation. It is also desirous to automatically adjust the lash due to space constraints around the engine and engine brake.

The placement of an adjusting screw for manually adjusting the lash between the engine brake system and the exhaust valve in the prior art has limited access of the adjusting screw, making attempts to adjust the lash cumbersome, cramped and therefore excessively difficult. Oftentimes, accessing the area to adjust the brake lash requires the removal of components to create additional working space. Also, special tools may be required to modify the angle of access to the lash adjustor.

The present invention is directed to overcome one or more of the problems as set forth above.

DISCLOSURE OF THE INVENTION

The present invention relates to an integral lash adjustor for an engine brake, and includes an engine brake stand having a top surface and defining an engine brake cavity. The engine brake stand has an opening that communicates with the top surface of the engine brake stand and with the engine brake cavity. The present invention further includes a plunger assembly on the top surface of the engine brake stand, and defines a plunger cavity. The plunger assembly has a plunger assembly opening in a top portion and a horizontal plunger assembly opening communicating with the plunger cavity and an outer surface of the plunger assembly.

A plunger is provided having a neck and a lower end. The plunger is slidably received within the plunger cavity and extends through the plunger assembly opening. The plunger further includes a horizontal passage therein.

An adjusting screw is threadably received within the plunger for adjusting the lash. A jam nut threadably received on the adjusting screw is in abutment with the neck of the plunger. A spring in communication with the lower end of the plunger and the engine brake stand is provided for biasing the plunger away from the top surface of said engine brake stand.

To adjust the lash, first the jam nut on the upper surface of the engine brake stand is loosened. Next, the plunger is prevented from rotation by the insertion of a dowel pin into the plunger body and a mating passage in the plunger. The adjusting screw is then turned in a first direction until a lower end of the adjusting screw contacts a valve bridge pin. Subsequently, the adjusting screw is turned in a second direction a predetermined number of turns to form a lash between the lower end of the adjusting screw and the valve bridge pin.

Finally, the jam nut is then tightened to secure the adjusting screw in a position relative to the plunger to maintain the lash.

BEST MADE FOR CARRYING OUT THE INVENTION

Figure 1:
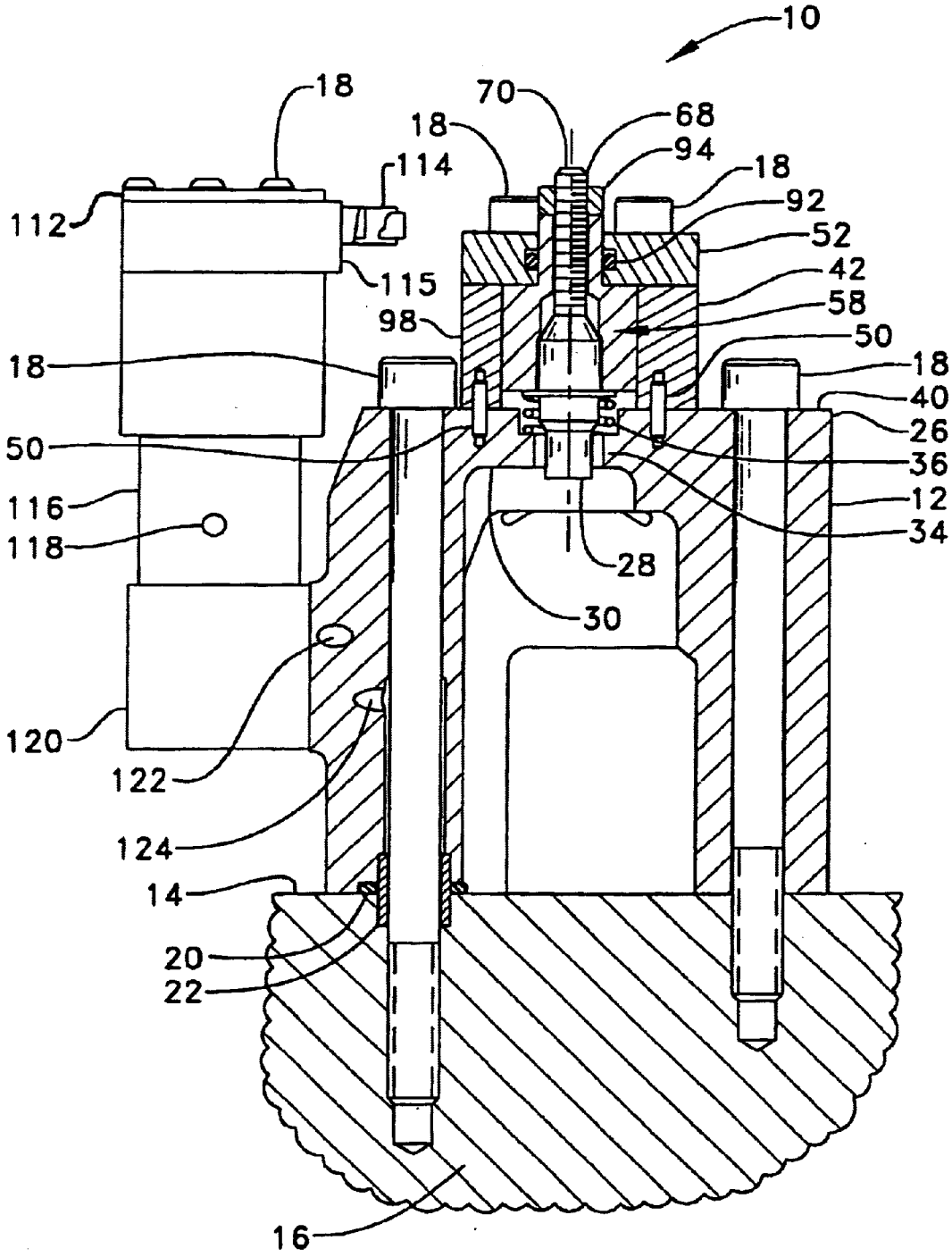
FIG. 1 is a cross-sectional view of an integral lash adjustor for a hydraulic compression brake of the present invention.

Referring now to FIGS. 1 through 5, and in particular to FIG. 1, an integral lash adjustor 10 for an engine brake 1 is shown. The integral lash adjustor 10 includes an engine brake stand 12 secured to a top side 14 of an engine block 16. The engine brake stand 12 is secured by at least one mechanical fastener 18. A nut/bolt assembly, locking nut/bolt assembly, or other fastener arrangement may be used as the mechanical fastener 18, as is common in the art depending on the requirements of the application. Surrounding the mechanical fastener 18 is an O-ring seal 20 and a hollow dowel 22 for locating the brake 1 relative to the engine block 16, in addition to providing a flow passage (not specifically shown) to an electronic valve assembly 110. The engine brake stand 12 is mounted to at least one engine cylinder (not shown).

The engine brake stand 12 has a top end 26 with an opening 28 therein for communication with an upper surface 30 of an engine brake cavity 32. The opening 28 has an internal rim 34 which defines a spring socket 36. The integral lash adjustor 10 further includes a plunger assembly 38 (FIG. 3) located on a top surface 40 of the engine brake stand 12.

Figure 3:
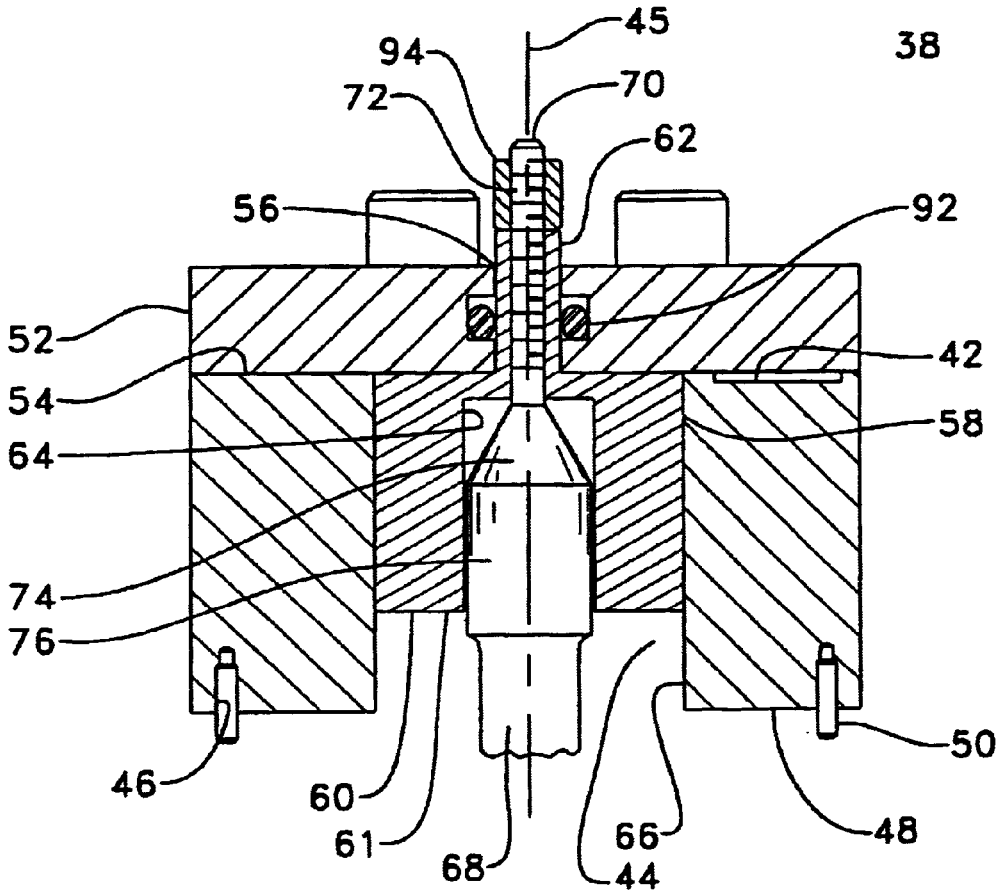
FIG. 3 is an enlarged cross-sectional view of a plunger assembly of the present invention.

The plunger assembly 38, best seen in FIG. 3, includes a plunger body 42 which defines a plunger cavity 44. The plunger body 42 is centered about a longitudinal axis 45 and has dowel pin receptacles 46 formed in a bottom surface 48 of the plunger body 42 for receiving dowel pins 50. The dowel pins 50 and dowel pin receptacle 46 help positively locate and align the plunger body 42 on the top surface 40 of the engine brake stand 12. Although dowel pins 50 are shown in this embodiment, it is to be appreciated that other equivalent aligning means may be used to achieve the same function.

While not part of the plunger assembly 38 proper, the plunger assembly 38 may include a plunger top portion 52, such as a cap or a cover, secured to an upper surface 54 of the plunger body 42. The top portion 52 has a plunger opening 56 centered about the longitudinal axis 45.

A plunger 58 has a relatively wide base portion 60 which is slidably received within the plunger cavity 44. Plunger base portion 60 terminates at a lower end 61. The plunger 58 also includes a relatively narrower neck portion 62 that is likewise slidably received within the plunger opening 56 of the plunger top portion 52. The plunger 58 defines a relatively narrower neck chamber 64 within the neck portion 62 that is in communication with a relatively wider base chamber 66 within the base portion 60.

Referring back to FIG. 1 and again to FIG. 3, integral lash adjustor 10 has an adjusting screw 68 which has a top surface 70, a first stem portion 72, a tapered stem portion 74 and a third stem portion 76. The first stem portion 72 is slidably received within the neck chamber 64 of the plunger 58. The third stem portion 76 is threadably received along thread (not shown) within the base chamber 66 of the plunger 58. The adjusting screw 68 may be mechanically adjusted at an adjusting screw top surface 70 by the use of an adjustor such as a screwdriver (not shown). The adjusting screw top surface 70 is adjusted to form a lash 82 between the adjusting screw 68 and a bridge 84 (FIG. 4).

Figure 4:
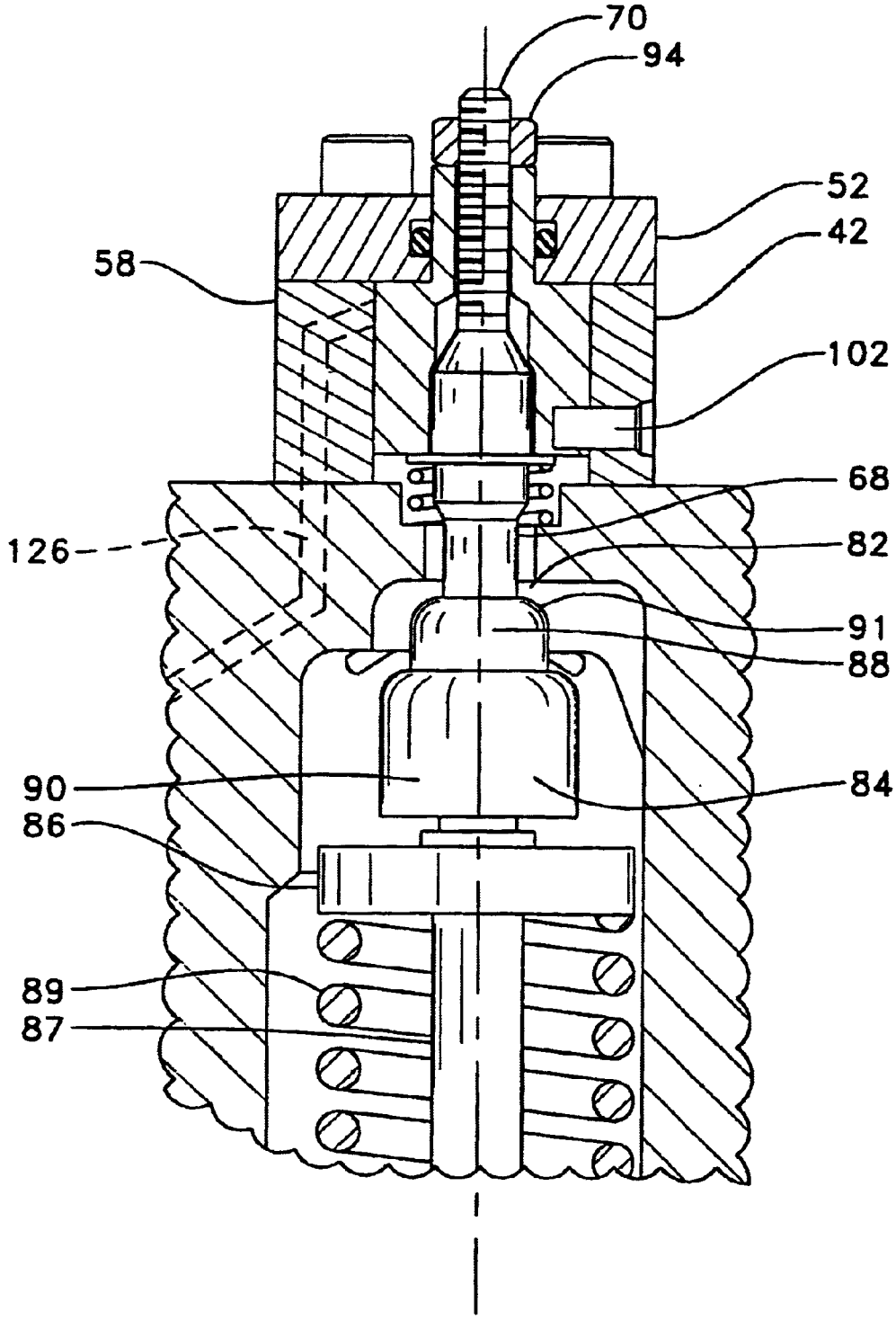
FIG. 4 is an exploded perspective view of the integral lash adjustor of FIG. 1.
Figure 5:
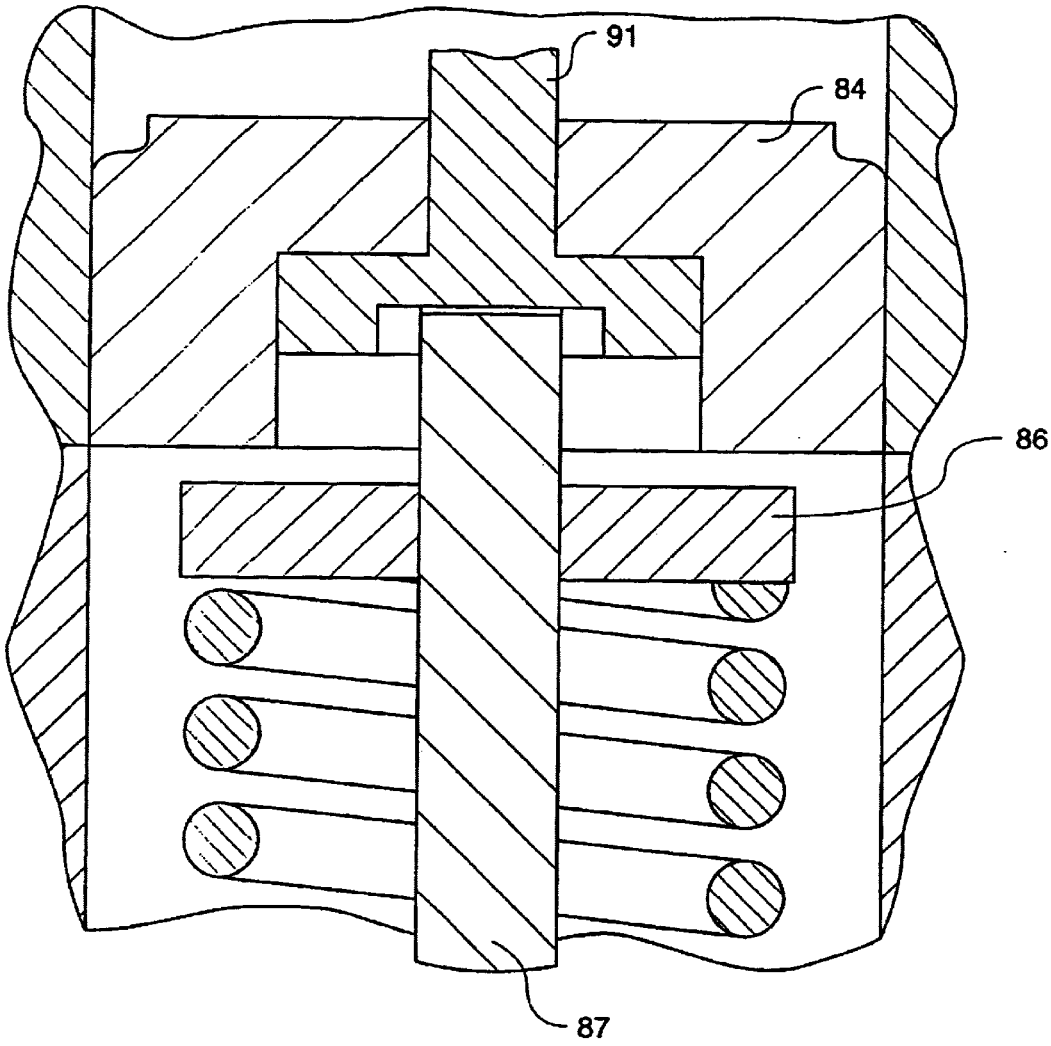
FIG. 5 is an enlarged cross-sectional view of the pin, bridge and valve stem arrangement for the integral lash adjustor of FIG. 1.

Referring now to FIGS. 4 and 5, the position of the adjusting screw top surface 70 provides an easily accessible location for adjusting the lash 82 a predetermined amount. The bridge 84 is positioned between the adjusting screw 68 and an engine valve rotocoil 86. The engine valve rotocoil 86 allows the engine valve stem 87 to rotate freely within the rotocoil 86 while being biased by valve spring 89. A bridge pin 91 runs axially through the bridge 84 for engagement by the plunger 58 during actuation of the engine brake and subsequently to a valve stem 87 for opening an engine valve (not shown) and releasing energy generated during the compression cycle of the engine (not shown).

Referring back to FIG. 1, a plunger body O-ring seal 92 is connected between the top portion 52 of the plunger assembly 38 and the plunger 58. A jam nut 94 is secured to the top portion 52 of the plunger body 42 for securing the adjusting screw 68 in a fixed position. The jam nut 94 houses the adjusting screw 68 and is secured to the adjusting screw 68 by threads (not shown). A plunger spring 98 surrounds the third stem portion 76 of the adjusting screw 68 and communicates with a lower end 61 of the plunger body 42 and the internal rim 34 of the opening 28 of the engine brake stand 12 for biasing the plunger 58 away from the engine brake stand 12.

Figure 2:
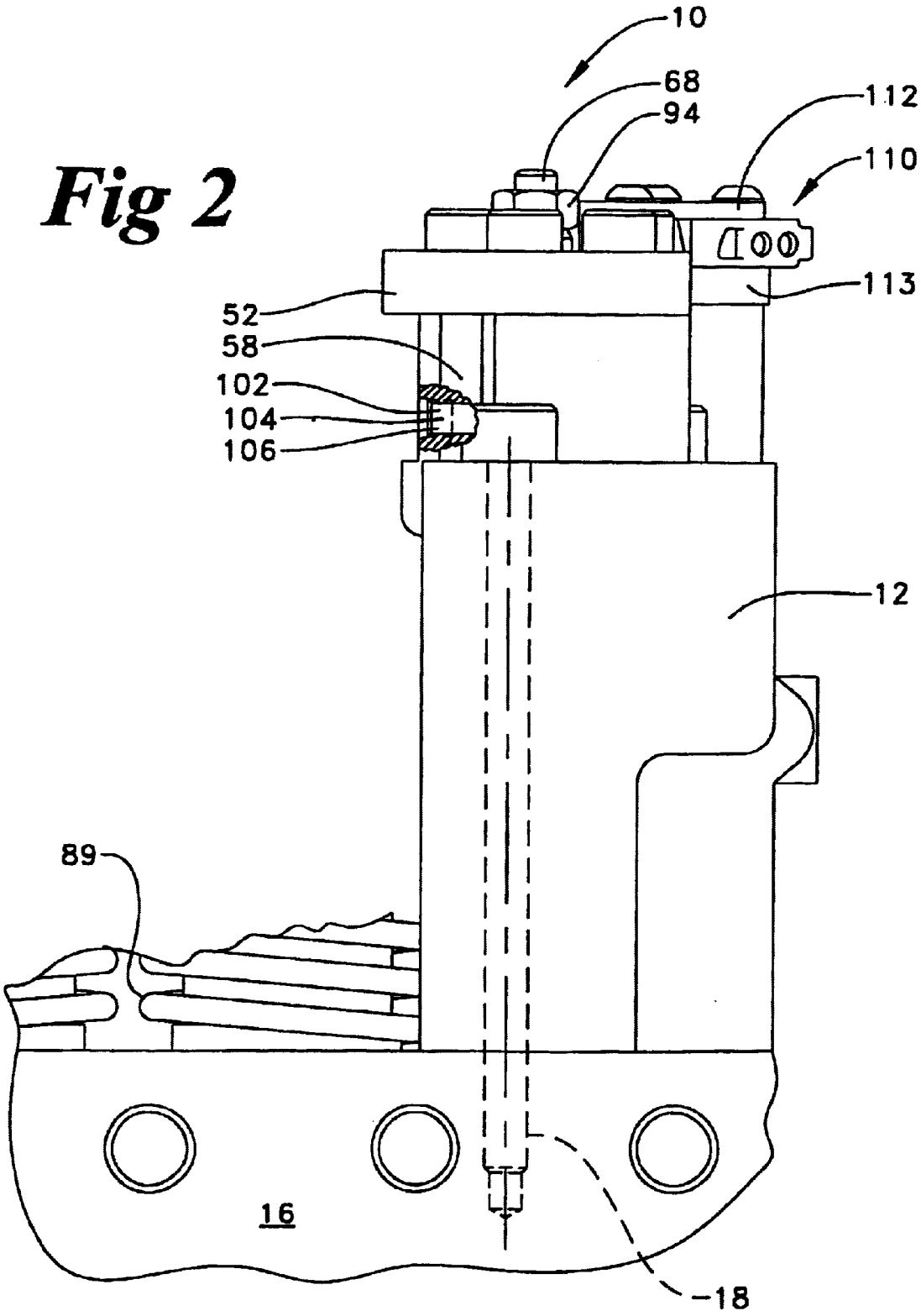
FIG. 2 is a side view of the integral lash adjustor of FIG. 1, with a partial cross-section showing a location of a plunger body dowel spring.

Referring now to FIG. 2, which shows a partial cross section of the integral lash adjustor 10, a plunger body dowel pin 102 is secured in a horizontal passage 104 of the plunger body 42 for insertion into a mating plunger horizontal passage 106 and the plunger 58. The plunger body dowel pin 102 connects to the horizontal passage 104 of the plunger body 42 by grooves (not shown). The plunger body dowel pin 102 is moved into position to prevent the adjusting screw 68 and the plunger 58 from rotating during operation, and to prevent only the plunger 58 from rotating during manual adjustment.

Referring back to FIG. 1, the electronic valve assembly 110 is shown. The electronic valve assembly 110 has a solenoid 112 on the top portion 113 of the electronic valve assembly 110, an engine brake connector 114 at the engine brake side 115 of the electronic valve assembly 110, a two-stage valve 116 below and connected to the solenoid 112, which has a hydraulic fluid drain hole 118, and an electronic valve coupler 120 below the two-stage valve 116 for coupling the electronic valve assembly 110 to the plunger body 42. The engine brake stand 12 has a engine brake inlet port 122 and an engine brake outlet port 124 for transporting hydraulic fluid between the electronic valve assembly 110 and the engine brake stand 12 via a plunger body fluid passage 126 (FIG. 4) and into the plunger cavity 44.

Referring now to FIG. 5, there is shown a enlarged cross-sectional view of the bridge 84. The bridge pin 91 runs axially through the bridge 84 to engage the plunger 58 (not shown) during actuation of the engine brake and to the valve stem 87 for opening the engine valve (not shown) and releasing energy during the compression cycle of the engine (not shown). A hydraulic actuator (not shown) may be used to selectively force hydraulic fluid through the plunger cavity 44 for forcing the plunger 58 and the adjusting screw 68 downwards to activate the engine brake 1.

Figure 6:
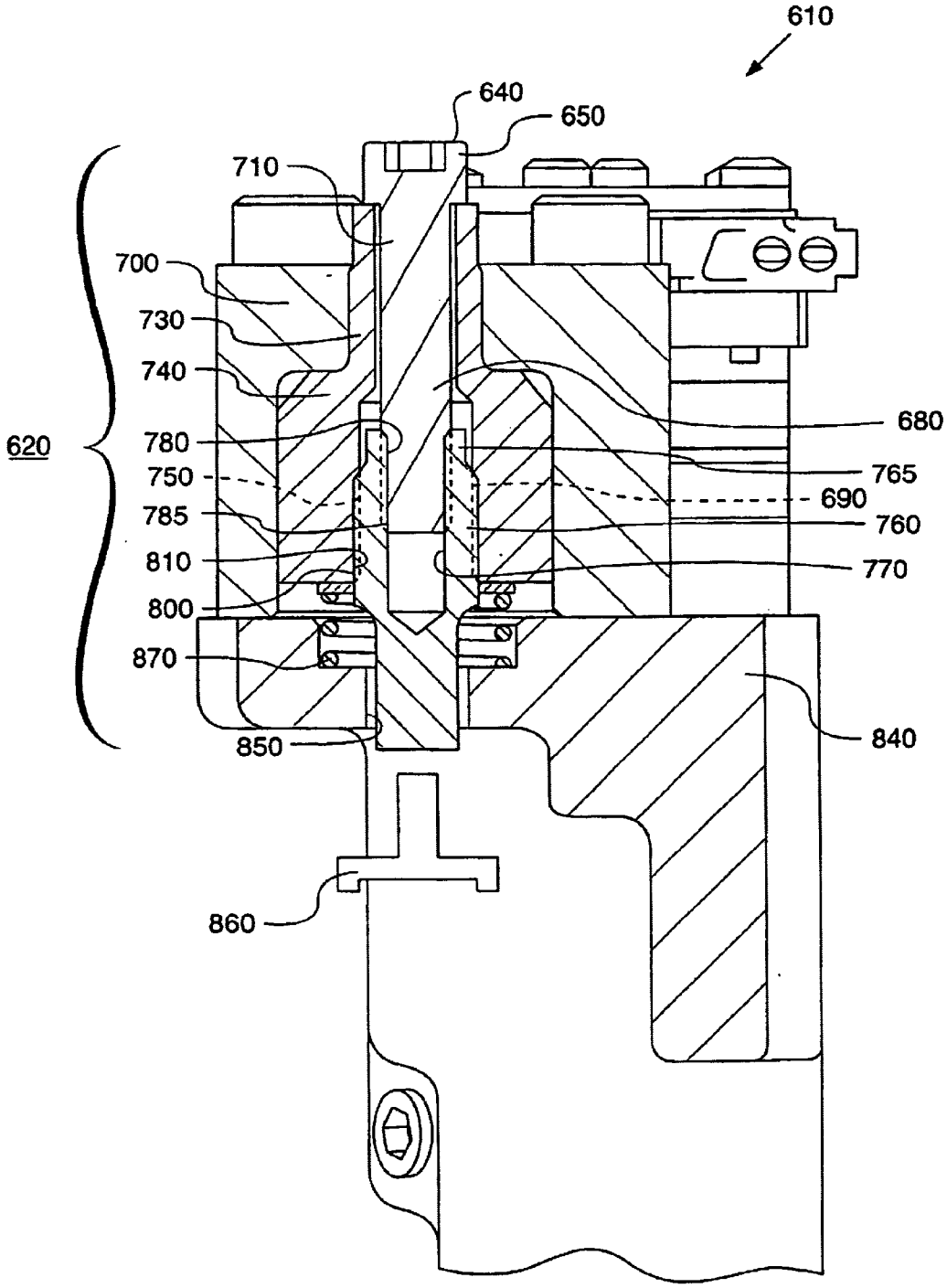
FIG. 6 is a cross-sectional view of an alternate preferred embodiment integral lash adjustor for a hydraulic combustion brake of the present invention.

Referring now to FIG. 6, there is shown an alternate preferred embodiment integral lash adjustor 610. Integral lash adjustor 610 includes a plunger assembly 620. The plunger assembly 620 has a plunger body 630 with an annular passage 635 therethrough. Located in the annular passage 635 is a bolt 640 having an upper portion 650 and a lower portion 680. The lower portion 680 of the bolt 640 has threads 690 thereon. A plunger 700 slidably surrounds the upper portion 650 of the bolt 640. The plunger 700 has an upper portion 710 and a neck 730, which is externally exposed and is adapted to be mechanically gripped. The plunger 700 further includes a lower portion 740 having threads 750. A lash adjusting screw 760 is interposed between the threads 750 of the plunger 700, and the threads 690 of the bolt 640. The lash adjusting screw 760 has a first portion 765 containing a channel 770 for receiving the bolt 640 therethrough.

Figure 7:
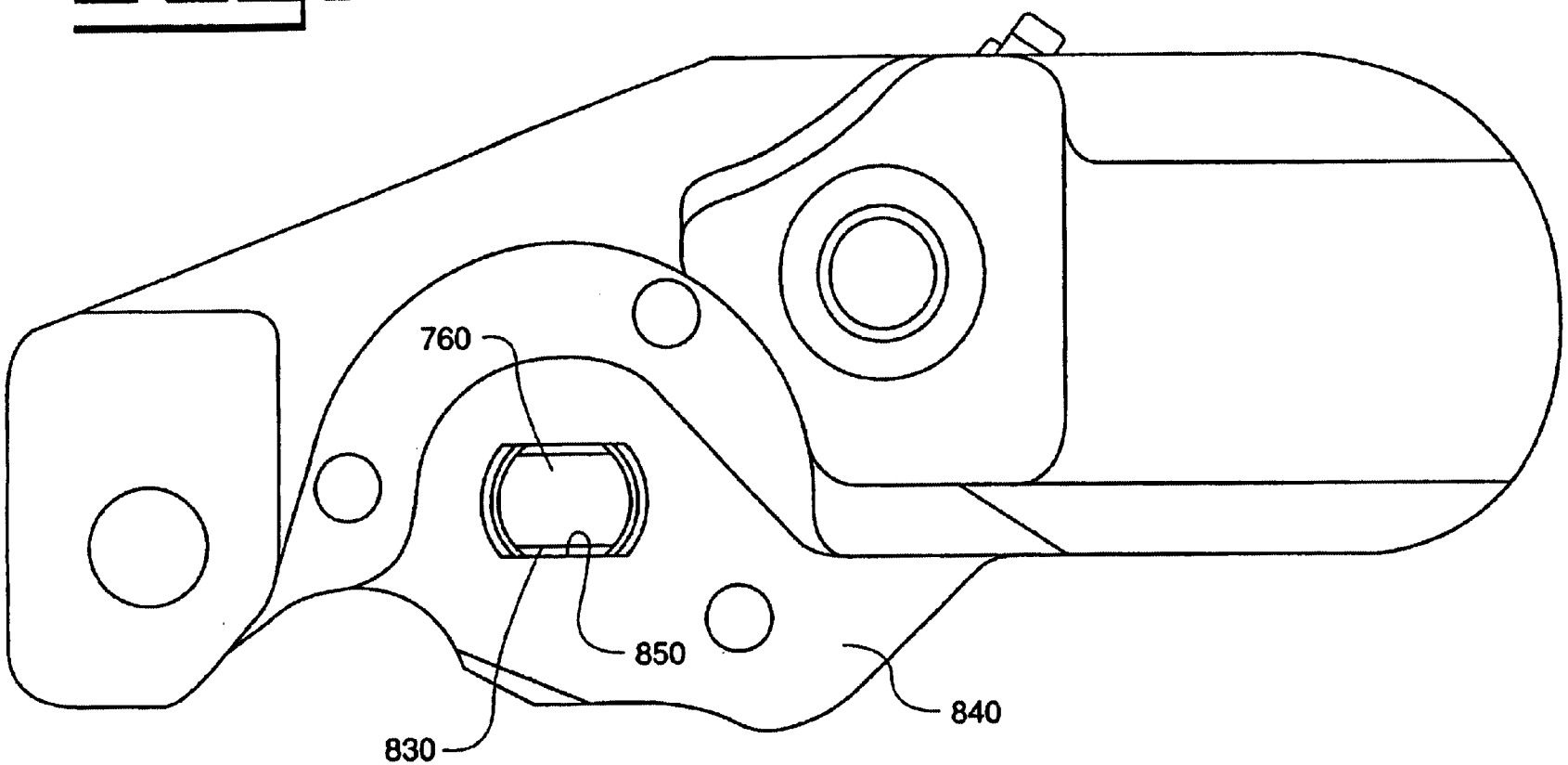
FIG. 7 is a bottom perspective view of an engine brake stand used in accordance with the embodiment of FIG. 6.

On an inner diameter 780 of the first portion 765 are grooves 785 adapted to mate with threads 690 and secure the bolt 640 thereto. Likewise, the lash adjusting screw 760 has an outer diameter 800 having grooves 810 adapted to receive and mate with the lower portion 740 of the plunger 700. A second portion 820 of the lash adjusting screw 760 is generally cylindrical and has at least two opposing flat surfaces 830 (FIG. 7). The integral lash adjustor 610 secures to the engine brake stand 840, which has a slot 850 designed to mate with the second portion 820 from the lash adjusting screw 760.

As best illustrated in FIG. 7, the slot 850 mates with the second portion 820 having the flat surfaces 830 to prevent complete rotation, but allow some rotation of the lash adjusting screw 760.

In certain embodiments, the engine brake stand 840 may be adapted to receive a spring 870 to bias the plunger 700 away from the engine brake stand 840. However, the addition or subtraction of the spring 870 will not affect the lash once speed lash has been adjusted through the integral lash adjuster 610.

INDUSTRIAL APPLICABILITY

In applications of engines using retarders of the compression release type, an engine is converted temporarily into an air compressor. The exhaust valves are opened near the end of the compression stroke of the engine. By so opening the exhaust valves out of normal engine operating sequence, the energy used to compress air in the engine cylinder is released through the exhaust system instead of being recovered during the power stroke of the engine. This energy, known as the retarding horsepower, may be a substantial portion of the power ordinarily developed by the engine and is effective as a supplemental braking system.

The integral lash adjustor 10 provides a device to quickly and easily adjust the lash 82, which had previously been difficult at best due to crowding of engine components. To adjust the integral lash adjustor 10, the jam nut 94 is first loosened to allow the adjusting screw 68 to be turned. Second, the plunger body dowel pin 102 is inserted into the horizontal passage 104 of the plunger body 42 through the mating plunger horizontal passage 106 to prevent the plunger 58 from rotating relative to the adjusting screw 68 due to the threaded connection of the adjusting screw 68 and plunger 58. Because the adjusting screw 68 is threaded into the plunger 58, and the plunger 58 is biased against the spring 98 and rotationally secured by the plunger body dowel pin 102, the adjusting screw 68 may rotate freely through the plunger 58. The adjusting screw 68 is next turned in a first direction using a screw driver or other turning device until the base adjusting screw portion 63 of the adjusting screw 68 is brought into contact with the bridge pin 91.

After contact has been established, the adjusting screw 68 is turned in the opposite direction a predetermined number of turns to set the lash 82 between the base adjusting screw portion 63 and the bridge pin 91. Once inserted, the plunger body dowel pin 102 remains in contact with the plunger 58, but the plunger 58 is allowed free vertical movement due to a vertical groove 128 on the plunger 58. Finally, the jam nut 94 is tightened about the adjusting screw 68 to maintain and fix the lash 82. The fixed position of the lash 82 is necessary to allow the thermal expansion of the bridge pin 91 during normal operation of an engine (not shown).

After the lash 82 has been set, the engine brake 1 may be actuated in the following manner: the engine brake connector 114 is secured to a connection site (not shown) on the engine brake 1; the solenoid 112 is manually or automatically activated and directs the two-stage valve 116, thereby delivering a predetermined amount of hydraulic fluid into the engine brake 1 through the engine brake inlet port 122; the hydraulic fluid enters the plunger neck chamber 64 and base chamber 66 through the plunger body fluid passage 126 and forces the plunger 58 and adjusting screw 68 downwards; the lower end 61 of the adjusting screw 68 contacts the valve bridge pin 91, which is in contact with the exhaust valve (not shown) of the engine cylinder (not shown); the exhaust valve is resultingly opened and acts to dissipate power during the compression stroke; the solenoid 112 directs the two-stage valve 116 to terminate the engine brake 1; hydraulic fluid flows out of the plunger body fluid passage 126 to the drain hole 118 and engine brake outlet port 124; the plunger 58 and adjusting screw 68 are biased upwards, mostly due to the engine valve spring (not shown), but assisted by the force of the plunger spring 98 and thereby return to the initial position.

The integral lash adjustor 10 thus provides several advantages over the prior art. First, it allows a user to easily access the adjusting screw 68 by providing the adjusting screw 68 on the top end 26 of the engine brake stand 12. Second, the integral lash adjustor 10 is situated to provide room to access the jam nut 94 and the adjusting screw 68 simultaneously. Third, the design of the integral lash adjustor 10 in combination with the electronic control valve assembly 110 provides electronic actuation of the plunger 58, which allows flexibility in the timing of the exhaust valve opening (not shown). This in turn allows the engine braking to be modulated by opening the exhaust valve (not shown) earlier in the compression stroke. Because less energy is released when opening the exhaust valve (not shown) early, less noise is produced. In addition, the added flexibility allows the valve to be opened more than once per engine cycle and also provides for use of an exhaust pulsed boosted cycle known in the art to produce more braking power than a typical compression brake. Finally, the integral lash adjustor 10 allows infinitely variable braking power between zero and maximum load.

The integral lash adjustor 610 operates in similar fashion to the prior embodiment. In operation, a bolt 640 is first loosened. Next, the plunger is turned in a first direction until the lash adjusting screw 760 contacts a bridge pin 860. The plunger 700 is next turned in an opposing direction a predetermined distance to set a lash. The plunger is next held into position while the bolt 640 is rotated to lock the lash in a fixed position.

Other objects and advantages of this invention can be obtained from a study of the drawings, the disclosure and the appended claims.

What is claimed:

1. An integral lash adjustor for an engine brake, comprising:

a plunger assembly;

said plunger assembly defining a plunger cavity and having a plunger assembly opening in a top portion, and a horizontal plunger assembly opening communicating with said plunger cavity and an outer surface of said plunger assembly;

a plunger having a neck and a lower end, said plunger slidably received within said plunger cavity and extending through said plunger assembly opening, said plunger having a horizontal passage therein;

an adjusting screw threadably received within said plunger;

a jam nut threadably received on said adjusting screw, said jam nut in abutment with said neck of said plunger; and a spring in communication with said lower end of said plunger for biasing said plunger away from said top surface of said engine brake stand.

2. The integral lash adjustor of claim 1, including:

a plunger body dowel pin in said horizontal plunger assembly opening for selectively engaging said adjusting screw through said horizontal passage of said plunger to prevent said adjusting screw and said plunger from rotating.

3. The integral lash adjustor of claim 1, wherein said adjusting screw is slidably received within said plunger neck and threadably received within said lower end of said plunger.

4. The integral lash adjustor of claim 1, wherein said lower end of said plunger has threads for securing to said adjusting screw, and said neck is smooth for slidably receiving said adjusting screw.

5. The integral lash adjustor of claim 1, wherein said plunger body is centered about a longitudinal axis and wherein said plunger assembly top portion opening is centered about said longitudinal axis.

6. The integral lash adjustor of claim 1, wherein said base portion of said plunger body is relatively wide and said neck portion is relatively narrow.

7. The integral lash adjustor of claim 1, wherein said plunger defines a relatively narrower neck chamber within said neck portion that is in communication with a relatively wider base chamber within said base portion.

8. The integral lash adjustor of claim 7, wherein said adjusting screw includes a top surface, a first stem portion, a tapered stem portion, and a third stem portion terminating at a lower end of said adjusting screw.

9. The integral lash adjustor of claim 8, wherein said first stem portion is slidably received within said neck chamber of said plunger and said third stem portion is threadedly received within said base chamber of said plunger.

10. The integral lash adjustor of claim 1, including a valve bridge received in said engine brake cavity, said valve bridge having a valve bridge pin which upon a predetermined force acts upon a valve stem.

11. The integral lash adjustor of claim 10, wherein said adjusting screw is adjusted at an adjusting screw top side to form a lash between said lower end of said third stem portion and said valve bridge pin.

12. The integral lash adjustor of claim 11, wherein said valve bridge is tapered from a first diameter to a second diameter.

13. An integral lash adjustor according to claim 1, including:

an engine brake stand having a top surface and defining an engine brake cavity, said engine brake stand having an opening that communicates with said top surface and with said engine brake cavity, wherein said plunger assembly is on said top surface of said engine brake stand and wherein said spring is in communication with said top surface of said engine brake stand.

14. An integral lash adjustor according to claim 13, including:

a fluid passage on said plunger body in communication with said plunger cavity for delivering hydraulic fluid to and for removing hydraulic fluid from said plunger cavity; and a hydraulic actuator for selectively forcing hydraulic fluid through said fluid passage into said plunger cavity for forcing said plunger and said adjusting screw downwards to activate said engine brake.

15. The integral lash adjustor of claim 14, wherein said hydraulic actuator is electronically controlled.

16. The integral lash adjustor of claim 15, wherein said electronically controlled hydraulic actuator includes:

a solenoid for actuating a valve;

an electronic connector for connecting said solenoid and said engine brake stand;

a valve connected to said solenoid for regulating hydraulic fluid, said valve having a drain hole to receive fluid from said plunger cavity;

an adapter for mechanically connecting the hydraulic actuator to said engine brake stand via an engine brake inlet port on said engine brake stand and an engine brake outlet port on said engine brake stand; and wherein said hydraulic actuator upon actuation feeds a predetermined amount of fluid into said engine brake inlet port through said fluid passage and into said plunger cavity, and receives return flow from said plunger cavity via said fluid passage through said engine brake outlet port and into said drain hole.

17. The integral lash adjustor of claim 16, wherein said valve is a two-stage valve.

18. The integral lash adjustor of claim 13, wherein said engine brake stand opening has an internal rim that defines a spring socket, and wherein said spring is in communication with said spring socket.

19. The integral lash adjustor of claim 13, wherein said plunger body has dowel pin receptacles formed in a bottom surface for receiving at least one dowel pin which positively locates said plunger body on said upper surface of said engine brake stand.

20. An integral lash adjustor, comprising:

a plunger assembly having a plunger body;

said plunger assembly defining a plunger cavity and having a plunger assembly opening in a top portion;

a plunger having a neck and a lower end, said plunger threadably received within said plunger cavity and extending through said plunger assembly opening, said plunger having an annular chamber extending therethrough;

a lash screw threadably received within said lower end of said plunger and having a lash screw opening and a lower end; and an adjusting screw extending through said neck of said plunger and through said lash screw opening.

21. The integral lash adjustor of claim 20, wherein said adjusting screw is slidably received within said plunger neck and threadably received within said lash screw.

22. The integral lash adjustor of claim 20, wherein said lower end of said plunger has threads for securing to said lash screw, and said neck is smooth for slidably receiving said adjusting screw.

23. The integral lash adjustor of claim 20, wherein said plunger body is centered about a longitudinal axis and wherein said plunger assembly top portion opening is centered about said longitudinal axis.

24. The integral lash adjustor of claim 20, wherein said base portion of said plunger body is relatively wide and said neck portion is relatively narrow.

25. The integral lash adjustor of claim 20, wherein said plunger defines a relatively narrower neck chamber within said neck portion that is in communication with a relatively wider base chamber within said base portion.

26. The integral lash adjustor of claim 20, wherein said adjusting screw includes a top surface adapted to be mechanically adjusted, a first stem portion, and a lower end adapted to secure to said lash screw.

27. The integral lash adjustor of claim 26, wherein said first stem portion is slidably received within said neck chamber of said plunger and said lower end of said adjusting screw is threadedly received within said lash screw.

28. The integral lash adjustor of claim 20, including:

an engine brake stand having a top surface and defining an engine brake cavity, said engine brake stand having an opening that communicates with said top surface and with said engine brake cavity, wherein said plunger assembly is on said top surface of said engine brake stand, wherein said opening is adapted to receive said lower end of said lash screw.

29. The integral lash adjustor of claim 28, wherein said plunger body has dowel pin receptacles formed in a bottom surface for receiving at least one dowel pin which positively locates said plunger body on said top surface of said engine brake stand.

30. The integral lash adjustor of claim 28, including:

a spring in communication with said lower end of said plunger for biasing said plunger away from said top surface of said engine brake stand.

31. The integral lash adjustor of claim 30, wherein said engine brake stand opening has an internal rim that defines a spring socket, and wherein said spring is in communication with said spring socket.

32. The integral lash adjustor of claim 30, wherein a circumference of said lower end of said adjusting screw has at least two opposing flat surfaces.

33. The integral lash adjustor of claim 32, wherein said engine brake stand opening includes a slot adapted to receive said at least two opposing flat surfaces of said adjusting screw and allow partial rotation of said adjusting screw.

34. The integral lash adjustor of claim 30, including:

a fluid passage on said plunger body in communication with said plunger cavity for delivering hydraulic fluid to and for removing hydraulic fluid from said plunger cavity; and a hydraulic actuator for selectively forcing hydraulic fluid through said fluid passage into said plunger cavity for forcing said plunger and said lash screw downwards to activate said engine brake.

35. The integral lash adjustor of claim 34, wherein said hydraulic actuator is electronically controlled.

36. The integral lash adjustor of claim 35, wherein said electronically controlled hydraulic actuator includes:

a solenoid for actuating a valve;

an electronic connector for connecting said solenoid and said engine brake stand;

a valve connected to said solenoid for regulating hydraulic fluid, said valve having a drain hole to receive fluid from said plunger cavity;

an adapter for mechanically connecting the hydraulic actuator to said engine brake stand via an engine brake inlet port on said engine brake stand and an engine brake outlet port on said engine brake stand; and wherein said hydraulic actuator upon actuation feeds a predetermined amount of fluid into said engine brake inlet port through said fluid passage and into said plunger cavity, and receives return flow from said plunger cavity via said fluid passage through said engine brake outlet port and into said drain hole.

37. The integral lash adjustor of claim 36, wherein said valve is a two-stage valve.

38. The integral lash adjustor of claim 34, including:

a valve bridge received in said engine brake cavity, said valve bridge having a valve bridge pin which upon a predetermined force acts upon a valve stem.

39. The integral lash adjustor of claim 38, wherein said adjusting screw is adjusted at an adjusting screw top side to form a lash between said lower end of said lash screw and said valve bridge pin.

40. The integral lash adjustor of claim 39, wherein said valve bridge is tapered from a first diameter to a second diameter.

41. A method for adjusting a lash in an engine brake, comprising the steps of:

loosening a jam nut on an upper surface of a plunger assembly secured to an upper surface of an engine brake stand wherein said jam nut surrounds and fixes an adjusting screw to a plunger;

preventing rotation of said plunger;

turning said adjusting screw in a first direction until a lower end of said adjusting screw contacts a valve bridge pin;

turning said adjusting screw in a second direction a predetermined number of turns to form a lash between the lower end of said adjusting screw and the valve bridge pin;

tightening the jam nut to secure said adjusting screw in a position relative to said plunger to maintain the lash.

42. The method for adjusting a lash in an engine brake of claim 41, wherein said preventing rotation of said plunger step includes the step of:

inserting a dowel pin into a horizontal opening in a side of a plunger body and into a mating passage in a plunger to prevent rotation of the plunger.

43. A method for adjusting a lash in an engine brake, comprising the steps of:

loosening an adjusting screw extending through a neck of a plunger having a lash screw extending therethrough, said adjusting screw being received within said lash screw, said plunger surrounding said adjusting screw and said lash screw;

turning said plunger in a first direction a predetermined number of turns to bring said lash screw into contact with a valve bridge pin in an engine brake stand;

turning said plunger in a second direction a predetermined number of turns to form a lash between a lower end of said lash screw and said valve bridge pin;

mechanically holding said plunger; and fixing said lash by tightening said adjusting screw.

* * * * *